US010227799B1

(12) United States Patent
Hallsten et al.

(10) Patent No.: US 10,227,799 B1
(45) Date of Patent: Mar. 12, 2019

(54) SLIDE LOCK FOR HATCH ON GAS CONTAINMENT COVER

(71) Applicant: Hallsten Corporation, Sacramento, CA (US)

(72) Inventors: Jeffrey A. Hallsten, Sacramento, CA (US); Roland Wright, Roseville, CA (US)

(73) Assignee: Hallsten Corporation, Sacramento, CA (US)

( * ) Notice: Subject to any disclaimer, the term of this patent is extended or adjusted under 35 U.S.C. 154(b) by 0 days.

(21) Appl. No.: 15/051,596

(22) Filed: Feb. 23, 2016

(51) Int. Cl.
*E05C 1/10* (2006.01)
*E06B 3/38* (2006.01)
*E06B 5/00* (2006.01)
*E06B 7/16* (2006.01)

(52) U.S. Cl.
CPC ..... *E05C 1/10* (2013.01); *E06B 3/38* (2013.01); *E06B 5/00* (2013.01); *E06B 7/16* (2013.01)

(58) Field of Classification Search
CPC ..... E05C 1/004; E05B 65/001
USPC ..... 292/145, 148
See application file for complete search history.

(56) References Cited

U.S. PATENT DOCUMENTS 4,470,623 A * 9/1984 Judge, Jr. ..... E05B 65/006 292/256.75
4,772,154 A * 9/1988 Caroulle ..... E02D 29/149 277/649
5,487,243 A * 1/1996 Hale ..... E06B 9/02 292/145
5,921,030 A * 7/1999 Ducotey ..... E04H 4/08 52/23
5,941,027 A 8/1999 Hallsten
6,012,259 A * 1/2000 Hallsten ..... E04B 7/00 52/246
6,102,452 A * 8/2000 Liau ..... E05C 1/04 292/145
6,120,070 A * 9/2000 Myers ..... B64C 1/066 292/153
6,151,835 A 11/2000 Hallsten
6,802,157 B2 10/2004 Hallsten
7,658,570 B2 * 2/2010 Hill ..... E02D 29/1418 220/232
8,375,478 B2 * 2/2013 Luo ..... E05B 17/0025 292/139
8,899,634 B1 * 12/2014 Stile ..... E05B 15/022 292/145
8,959,859 B2 * 2/2015 Haan ..... E05B 65/006 52/205
2015/0076836 A1 * 3/2015 Gooding ..... E05C 3/12 292/196

(Continued)

*Primary Examiner* — Colleen M Chavchavadze
*Assistant Examiner* — Catherine A Kelly
(74) *Attorney, Agent, or Firm* — Thomas M. Freiburger

(57) ABSTRACT

A hinged hatch in a gas containment cover particularly for a sewage treatment tank has a slide bolt contained within a shaped channel of an extrusion of the hatch, positioned to engage the bolt at a mid-level position of the adjacent fixed beam or other member of the tank cover. The position of the bolt enables the hinged hatch to fully seal against a rubber-covered lip of the adjacent structural member, so that the bolt latch does not compromise integrity of the gas seal. As the bolt is slid into locking position it forces the hatch cover down more tightly against the gas seal.

6 Claims, 6 Drawing Sheets

(56) References Cited

U.S. PATENT DOCUMENTS

2015/0083614 A1* 3/2015 Cox ..... B65D 90/10
206/1.5

* cited by examiner

SLIDE LOCK FOR HATCH ON GAS CONTAINMENT COVER

BACKGROUND OF THE INVENTION

This invention concerns covers for containment of noxious and odorous gases such as in sewage treatment facilities, and particularly the invention is directed to a hatch cover or access panel for access to a tank having such a fixed cover, particularly a cover formed of assembled aluminum extrusions.

A number of patents of Hallsten Corporation (Sacramento, Calif.) have described fixed covers for sewage treatment process tanks, pursuant to requirements for containing noxious and odorous gases against freely escaping into the atmosphere. See, for example, U.S. Pat. Nos. 5,941,027, 6,012,259, 6,151,835 and 6,802,157. In all the described fixed covers, the construction was of extruded aluminum slat components connected together by edges and by engaging in channels at ends of the slats. Where a liftable panel or hatch cover was provided, or where the fixed cover structure rested on a tank edge at the periphery of the tank, rubber gasket material was included to provide a substantial, if not total, gas seal.

Hinged hatches or access panels were provided in some of the fixed tank covers of the above-listed patents. These have typically been slide latches wherein a locking finger, when the slide member is moved to the locking position, would engage underneath a beam or other fixed structure adjacent to the movable, hinged panel. This, however, required some form of seal to be made around the slidable component, since the handle was available from above the hatch's seals and the latching finger was below. Such seals were imperfect and prone to leakage, and could not be relied on to contain gases from escaping.

It is an objective of the current invention to provide an improved slide bolt-type latch for a liftable access panel in a fixed tank cover, wherein the gas seal between the liftable panel and surrounding fixed structure is not compromised.

SUMMARY OF THE INVENTION

The invention provides a fixed tank cover of assembled extruded aluminum components that has an access hatch or liftable panel that is reliably sealed against the surrounding structure, which can be aluminum fixed cover components on all sides, or which can include a tank rim of concrete or other material at one side.

In the system of the invention a liftable access panel is formed of assembled extrusions as deck slats, one or more edge extrusions of which have a channel that receives a bar latch or slide bolt, at a level approximately midway between the top and bottom of the access panel. When the bolt is slidingly moved to a locking position, its end extends out from the extrusion within which it is captured, to engage within a channel of adjacent fixed structure of another aluminum component, the adjacent channel being perpendicular to the direction of movement of the slide bolt. Importantly, a rubbery seal (which may be the material SANTOPRENE) provides a seal between the liftable hatch cover and the adjacent structure, and the slide bolt is positioned above this seal. Thus, the locking down of the hatch cover is done with structure which does not penetrate or interfere in any way with the seal between the liftable cover and the surrounding fixed structure.

In a preferred embodiment the slide bolt is rectangular or square in cross section, and engages under a slightly angled ledge of the channel which it enters. This causes the sliding of the bolt to push the liftable panel down more tightly against the rubbery seal when the slide bolt is fully engaged. The square slide bolt resides in an extruded square capturing channel, the channel having a continuous slot opening at one corner. A handle for the slide bolt or bar latch is secured to the bolt and extends out through this corner opening, in a position to conveniently be gripped by a user. In one embodiment this handle is formed of a machine screw that enters a tapped through bore formed diagonally in the square slide bolt. The machine screw can be tightened down after the bolt is in locking engagement, therefore securing the bolt in the latched position.

It is therefore among the objects of the invention to improve over previous latches for access panels in a fixed tank cover structure formed of assembled aluminum extrusions, by a slide bolt that is captured in an extrusion of the liftable hatch cover and positioned above the gas seal between the liftable cover and surrounding fixed structure, thus maintaining integrity of the gas seal. These and other objects, advantages and features of the invention will be apparent from the following description of a preferred embodiment, considered along with the accompanying drawings.

DESCRIPTION OF PREFERRED EMBODIMENTS

Figure 1:
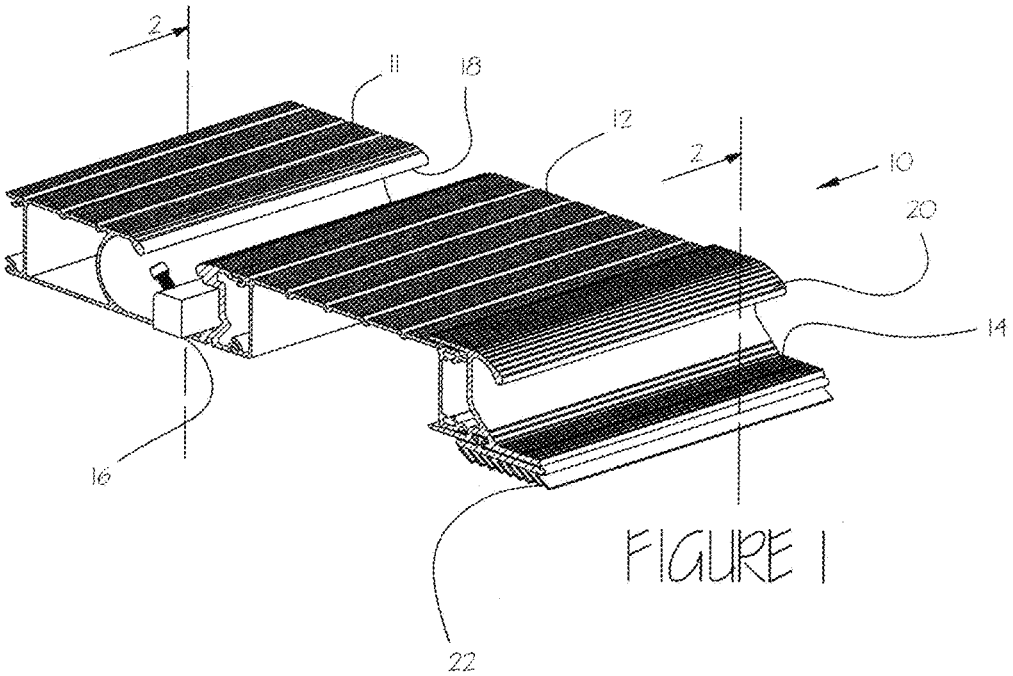
FIG. 1 is a perspective view in cross section showing a portion of an access panel for a tank cover and including a bar latch according to the invention.

FIG. 1 shows a portion of an access panel or liftable hatch cover 10 of the invention, an assembly of aluminum extrusions or deck slats 11, 12 and 14, and including a slidable bar latch or bolt 16 that is captured within the extrusion 12. In the drawing the near edges of the extrusions are in cross section since the extrusions will extend considerably farther. At the far edges of the extrusions a framing channel is omitted (see FIG. 3). The bolt 16 comprises a metal bar, preferably an aluminum bar. The access panel can be of a structure generally as shown in U.S. Pat. No. 5,941,027, owned by the assignee of the current invention and incorporated herein by reference. The extrusion 11 is formed with a handle 18. The end extrusion 14 can also be formed with a handle 20. The end extrusion 14 is configured for engaging down against the rim of a tank (a rim 34 of a tank being seen in FIG. 2, the tank volume being to the left), and for this purpose has an attached rubbery chevron seal 22, which can advantageously be of the material SANTOPRENE. These components are connected together as shown in previous patents of the assignee of this invention, including that mentioned above and also U.S. Pat. Nos. 6,012,259, 6,151,835 and 6,802,157.

Figure 2:
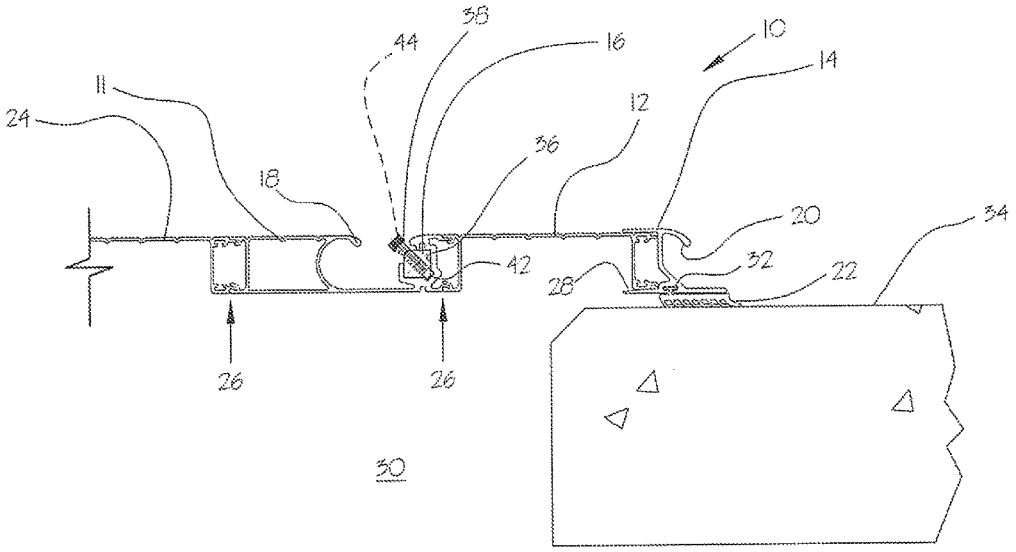
FIG. 2 is a sectional elevation view showing a portion of the access panel installed on a tank cover.

FIG. 2 shows the access panel structure 10 in cross section and better illustrates the connection of aluminum extrusion components 11, 12 and 14. The extrusions 11 and 12, as well as an extruded component 24 shown at left in FIG. 2, are deck slats that are secured together by interlocking connections 26 as illustrated and as known from the previous patents of the assignee as listed above. The ends of these slats, not seen in the sectional view of FIG. 2, are received in a close fit in framing channels that engage over the ends of these slats, similar to the channel 28 shown in FIG. 2 on the edge component 14. All these connections can also be secured and sealed together with an appropriate adhesive, and they form a gas seal for the tank space 30 below, which typically is a vessel for a sewage treatment process. In the type of access panel 10 shown in FIGS. 1 and 2, the access panel would have a hinged edge to the left, not shown, and at the right is the rubbery gasket seal 22 that is secured into the bottom of the extrusion 14 via a capturing recess 32 as shown, and which bears down against a tank rim 34, which is shown as concrete in this case. Note that the liftable access panel need not be hinged but could drop into place on surrounding fixed structure if desired.

The slide bolt or bar latch 16 is shown within a capturing slide channel 36 of the handle slat 11, and is slidable in/out of the page as viewed in FIG. 2. The bar latch 16 can be manually moved outwardly to the position shown in FIG. 1, via a handle 38 which in this embodiment is shown as a machine bolt threaded into a tapped hole through the bar 16. With the slide channel 36 open at the upper left corner, i.e. with an open continuous slot (as seen in FIG. 2), the machine bolt handle 38 is positioned obliquely, preferably diagonally as shown, in the bar or bolt 16. The threaded hole 40 is shown in dashed lines in FIG. 5.

Figure 5:
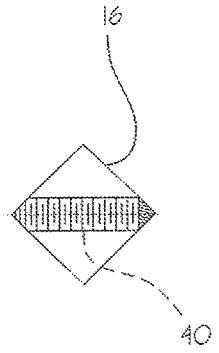

One advantageous feature of the invention is that the generally square capturing channel 36 of the extrusion 11 is formed with a modified corner at 42. That corner is formed into a squared, obliquely angled trough with a surface that is preferably at right angles to the orientation of the bolt 38. The threaded bore 40 passes completely through the bar 16 as shown in FIG. 5, and the machine bolt 38 can therefore be tightened down against the surface of the trough 42 when the bar latches in the locked position, to retain that position. As indicated in FIG. 2 in dashed lines, a plastic or rubber gripping handle 44 can be secured to the head of the machine bolt 38.

The squared trough 42 is a low point in the capturing channel 36 and provides free space adjacent to the latch bolt. This helps drain water from the channel 36, as well as dirt and debris that tends to fall into the channel. The bolt 16 can sweep the debris out of the channel when slid back and forth.

Figure 3:
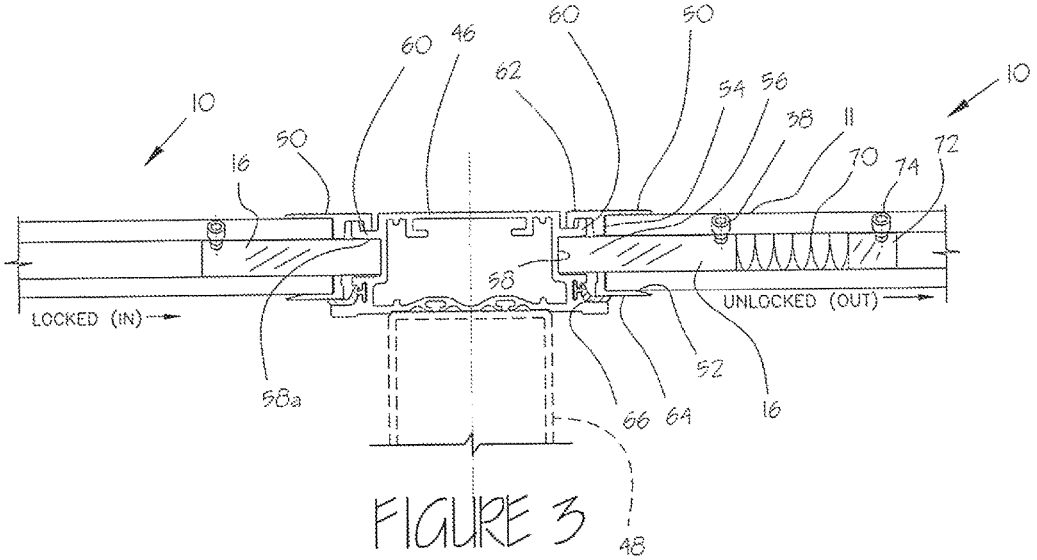
FIG. 3 is a sectional elevation view from a different direction showing the access panel latch system of the invention.

FIG. 3, a cross section which is a view taken from a perspective perpendicular to that of FIG. 2, shows operation of the bar latch of the invention. In this case two parallel access panels 10 are shown, both hinged along axes (not shown) parallel to the path of sliding of the bar latches 16, although these could simply be lift panels without hinges. A beam, i.e. an interlocking beam tube 46, which is secured to a structural beam 48 indicated below, is between the two access panels 10. The access panels can be locked to the fixed-position interlocking beam tube 46, which is to the side of each access panel.

Figure 6:
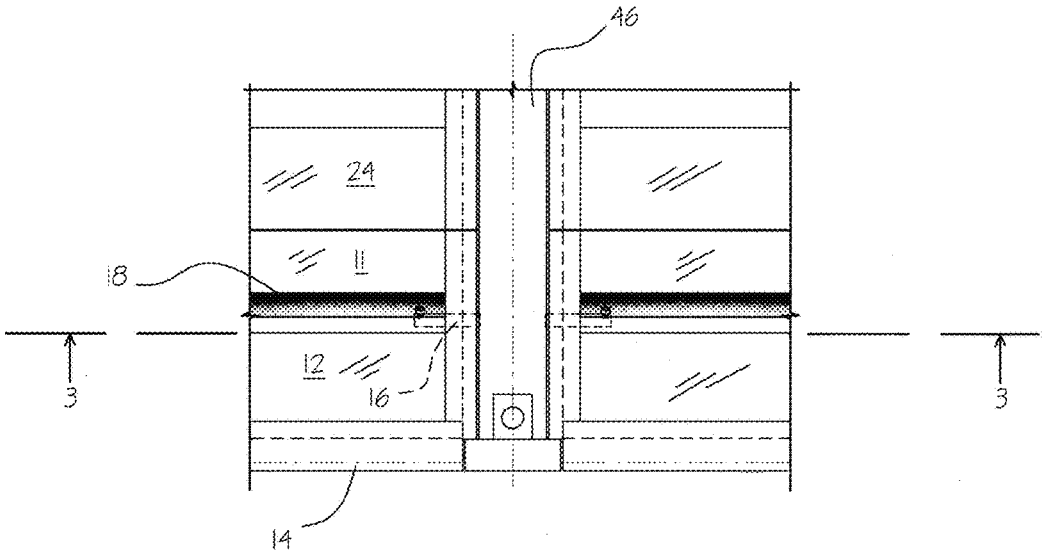
FIG. 6 is a plan view showing portions of two access panels with slide bolt latches.

FIG. 6 shows portions of the two liftable panels in a truncated plan view. FIGS. 3 and 6 show that the handle slat 11, along with the adjacent deck slats 24 and 12 as shown in FIG. 2, are secured together at ends with an interlocking deck channel or framing channel 50 which was not seen in the sectional view of FIG. 2 or the partial perspective view of FIG. 1. The deck channel, as shown in FIG. 3, receives ends of the interconnected, parallel deck slats that make up the panel, some of which are shown at 24, 11 and 12 in FIG. 2. The ends 52 of these slats fit tightly within the deck channel 50, and such channels 50 at both sides of the access panel (other side not shown) secure the panel together.

Figure 3A:
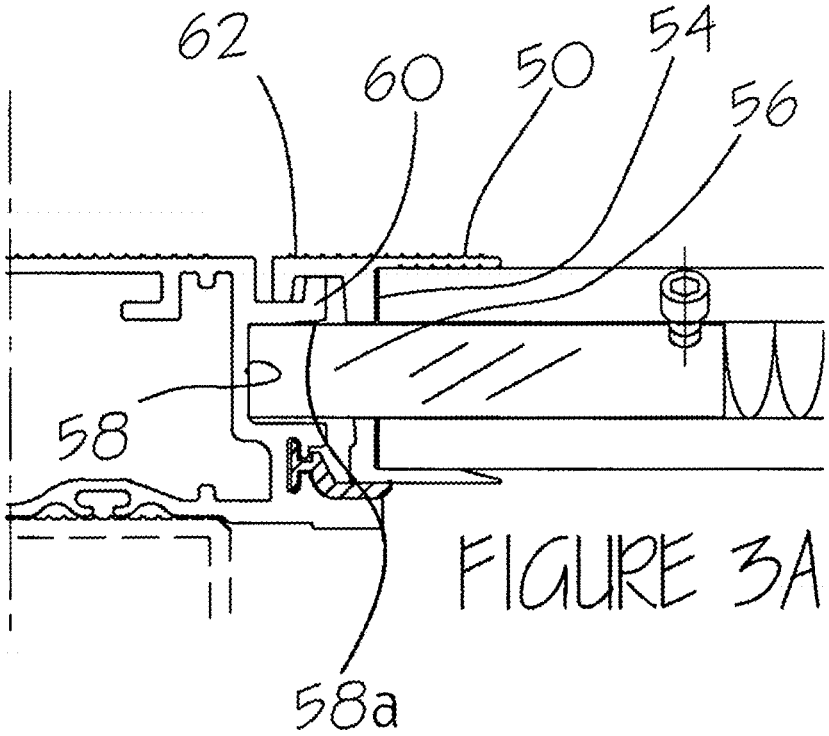
FIG. 3A is a detail view of the structure shown in FIG. 3.
Figure 4:
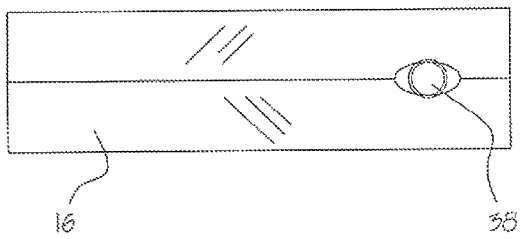
FIGS. 4 and 5 are side and end views showing the bar latch or bolt of the latching system.

FIG. 3 shows that the deck channel 50 has a web 54 with an opening 56 that allows for the sliding of the latch bar 16 out the side of the liftable panel 10, to engage in a locking channel 58 that is formed in the side of the fixed interlocking beam tube 46. Note that this latch-receiving channel 58 has an upper flange 60 that engages with a flange 62 just above, the flange 62 being part of the interlocking deck channel 50. The bottom of the deck channel 50, indicated at 64 in the drawing, rests down against a panel seal 66 that is assembled to the fixed interlocking beam tube 46 by being captured in that extrusion as shown in FIG. 3 (a seal could alternatively be on the channel 50). The side of the liftable access panel 10 thus rests down against and somewhat compresses the panel seal 66, to form a continuous gas seal along that edge of the panel, between the panel 10 and the fixed interlocking beam tube 46. The same thing occurs at the other side of the interlocking beam tube 46, in this case where another liftable access panel 10 is positioned just across the beam 46. In FIG. 3 both bar latches 16 are shown engaged, i.e. in locked positions. The drawing shows that the upper flange 60 of the interlocking deck channel 50 preferably has an angled surface **58*a* slightly sloped (downwardly-inwardly) so that when the bar latch 16 is pushed into the locked position shown on the right side of the drawing, this actually forces the access panel 10 down slightly, making a tighter seal. FIG. 3A shows the slightly sloped surface 58*a* in an enlarged partial view. Further, when the machine screw handle 38 is turned to lock the bar latch in place, this moves the bar 16** slightly more upwardly, adding further to the seal-compressing effect.

It is noted that the bar latch or slide bolt 16 need not be rectangular or square as shown. It can be a round bar in a similarly-shaped capturing channel, or any other shape. It could be round but with a flat at one side, for better engagement with the angled channel surface **58*a* shown in FIG. 3**.

FIG. 3 shows another feature of the locking system of the invention included in the preferred embodiment. A compression spring 70 can be included within the slide channel 36 of the extrusion 11, captured therein and assembled through the opening 56 in the channel 50, prior to assembling of the bar 16 into place. At its back end the spring bears against a stop, which can be a short, fixed piece of square bar 72, held in place by a fastener or by another locking machine bolt 74, as shown. The spring 70 has several purposes: to urge the bar latch 16 to the locked position in the event the operator does not lock down the machine bolt set screw 38, and to push the locking bar 16 outwardly after the operator has opened and lifted the panel. This will prevent the panel from falling back to the fully closed position accidentally, when a service person may be down inside the tank. Note that the liftable panel 10 will have a width much greater than the portion seen in FIG. 3, and a sliding bar latch will typically be provided at the other side of the panel as well, to the right as viewed in FIG. 3. A similar spring 70 and locking bar 72 arrangement will be included at the other side of the panel, and thus when the panel is opened both bar latches 16 will be extended to prevent accidental closure.

In one embodiment of the invention the interlocking beam tube 46 has a height of about two inches and a width of about five inches, with the interlocking deck slats 11, 12, 24, etc.

being of slightly less height, e.g. about 1⅝ inch. The bar latch can be square, ¾ inch by ¾ inch, with a length of about four inches. The opening for extension of the bar latch, in the deck channel 50, can be about one inch by two inches. The handle/set screw 38 can be a 5/16 by 1¼ inch 316 stainless steel socket head cap screw. These components can be in different dimensions if desired, so long as a proper and close fit is produced, to compress the gas seal as described above.

The access panel locking system of the invention provides, for a fixed tank cover formed of aluminum extrusions, a conveniently used lock mechanism that is efficiently fabricated and which preserves the gas seal between liftable panels and fixed structure, e.g. the beam 46 of FIG. 3 or the tank rim 34 of FIG. 2), requiring no openings or slots below or through the gas seal of the assembly.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. In a fixed tank cover on a gas-containing tank, the tank cover being formed of assembled aluminum extrusions including slats secured together at edges and retained in channel members at ends, and including at least one liftable access panel within the fixed tank cover, a latch system for the access panel configured to preserve a gas seal at an edge of the access panel when closed, comprising:

the access panel being formed of a plurality of parallel deck slats interlocked edge to edge, with ends of the deck slats retained in a framing channel member at one side of the access panel, and the access panel having a liftable end, perpendicular to said one side, that bears down against an adjacent fixed surface of the fixed tank cover in sealed relationship therewith, a fixed structure adjacent to said one side of the access panel, the fixed structure comprising a beam of the fixed tank cover, the beam having a ledge which is continuous along a length of the access panel and extends under a bottom surface of the framing channel member, with a flexible gasket sealed between the ledge and said bottom surface when the access panel is closed and rests on the gasket seal, providing said gas seal between the access panel and the fixed structure, at said one side of the access panel the framing channel member having an opening above said bottom surface, one of the plurality of parallel deck slats of the access panel having an extruded capturing channel having a side opening forming an elongated continuous slot, the capturing channel being aligned with the opening in the framing channel member, with a bar latch positioned slidably in the capturing channel and including a gripping handle secured to the bar latch and extending out of the capturing channel through the elongated continuous slot permitting the gripping handle to be gripped by a user to slide the bar latch outwardly to extend through the opening of the framing channel member and outwardly from the access panel, and said beam of the fixed tank cover having a recess aligned with the bar latch when the access panel is closed, to receive the bar latch when extended and thus to latch the access panel to the beam of the fixed tank cover to prevent opening of the access panel, the recess comprising an extruded channel formed in the side of the beam and having an open side facing the bar latch, so as to receive the bar latch, the channel having a sloped upper surface to force the access panel downwardly against the gasket seal as the bar latch is pushed into a locking position, whereby the gas seal is not compromised by the latch system, the slidable bar latch being positioned above said bottom surface of the framing channel member so as not to interrupt the gas seal between said bottom surface and said ledge.

2. The latch system of claim 1, wherein the bar latch is rectangular in cross section and the capturing channel is of a complementary shape for sliding of the bar latch in the channel.

3. The latch system of claim 2, wherein the gripping handle of the bar latch is a machine bolt in a threaded bore of the bar latch, the threaded bore extending diagonally through the rectangular bar latch, providing for tightening of the machine bolt to act as a set screw to hold the bar latch in position.

4. The latch system of claim 1, further including a compression spring within the capturing channel and positioned to urge the bar latch outward toward the locking position.

5. The latch system of claim 4, wherein the spring engages against a stop element positioned in the capturing channel.

6. The latch system of claim 1, wherein said one of the plurality of parallel deck slats with the extruded capturing channel includes an extruded handle adjacent to and formed parallel with the capturing channel.

* * * * *